US007044632B2

(12) United States Patent
Midas

(10) Patent No.: US 7,044,632 B2
(45) **Date of Patent: *May 16, 2006**

(54) LIFTING APPARATUS FOR PAINT MIXERS

(75) Inventor: Thomas J. Midas, Oak Park Heights, MN (US)

(73) Assignee: Red Devil Equipment Company, Plymouth, MN (US)

( * ) Notice: Subject to any disclaimer, the term of this patent is extended or adjusted under 35 U.S.C. 154(b) by 57 days.

This patent is subject to a terminal disclaimer.

(21) Appl. No.: 10/863,026

(22) Filed: Jun. 8, 2004

(65) Prior Publication Data

US 2004/0218466 A1 Nov. 4, 2004

Related U.S. Application Data

(63) Continuation-in-part of application No. 10/818,996, filed on Apr. 6, 2004, now Pat. No. 6,926,436, which is a continuation of application No. 10/235,978, filed on Sep. 5, 2002, now Pat. No. 6,729,754.

(51) Int. Cl.
*B01F 11/00* (2006.01)
*B01F 15/00* (2006.01)

(52) U.S. Cl. ..... 366/208; 366/605

(58) Field of Classification Search ..... 366/110–112, 366/114, 208–217, 219, 349, 605; 294/28, 294/68.3, 74; 254/93 R; 198/468.8; 414/756, 414/779, 783, 419, 738

See application file for complete search history.

(56) References Cited

U.S. PATENT DOCUMENTS

| | | | | |
|---|---|---|---|---|
| 2,752,054 | A * | 6/1956 | Thompson | 414/733 |
| 2,852,148 | A * | 9/1958 | Jones | 414/495 |
| 2,865,523 | A * | 12/1958 | Morrison | 414/733 |
| 4,213,727 | A * | 7/1980 | Lighthipe, Jr. | 414/420 |
| 5,116,134 | A * | 5/1992 | Edwards et al. | 366/208 |
| 5,137,367 | A * | 8/1992 | Madonia et al. | 366/218 |
| 5,383,163 | A * | 1/1995 | Brunn | 366/217 |
| 5,577,875 | A * | 11/1996 | Nanzai | 414/680 |
| 5,749,652 | A * | 5/1998 | Brunn et al. | 366/209 |

(Continued)

OTHER PUBLICATIONS http://www.industrialgassprings.com/Brochure/Page6.asp, "Industrial Gas Springs—Information Pages", downloaded Aug. 5, 2002, 4 pages.

(Continued)

*Primary Examiner*—Charles E. Cooley
(74) *Attorney, Agent, or Firm*—Faegre & Benson LLP

(57) ABSTRACT

A lifting apparatus for lifting paint containers into and out of paint mixers of the type supported by a generally horizontal surface and including at least one side, the lifting apparatus having a pair of rigidly connected arms, each including a proximal end pivotably connected to a support structure and a distal end extending from the support structure, a mechanical link in the form of a strap and hook connected to a cross member connecting each of the pair of arms for lifting and lowering a paint bucket into and out of the paint mixer and a pair of gas springs connected between the support structure and the lifting arms for urging the lifting attachment upwards. The support structure may be separate from the paint mixer and may include sliding as well as pivoting movement between the arms and the support structure.

24 Claims, 18 Drawing Sheets

U.S. PATENT DOCUMENTS

| | | | | |
|---|---|---|---|---|
| 5,810,548 | A * | 9/1998 | Stenudd | 414/680 |
| 6,612,732 | B1 * | 9/2003 | Blakeman et al. | 366/209 |
| 6,729,754 | B1 * | 5/2004 | Midas | 366/208 |
| 6,926,436 | B1 * | 8/2005 | Midas | 366/208 |
| 2004/0190370 | A1 * | 9/2004 | Midas | 366/208 |
| 2004/0218466 | A1 * | 11/2004 | Midas | 366/208 |

OTHER PUBLICATIONS

Red Devil Equipment Co., brochure, "The 5305 Speed Demon Series" dated prior to Sep. 5, 2002, 2 pages.

Red Devil Equipment Co., brochure, "Simple Design-Durable Products-Full-Line Provider" dated prior to Sep. 5, 2002, 16 pages.

* cited by examiner

LIFTING APPARATUS FOR PAINT MIXERS

CROSS-REFERENCE TO RELATED APPLICATIONS

This application is a Continuation-In-Part of application Ser. No. 10/818,996, filed Apr. 6, 2004 now U.S. Pat. No. 6,926,436, which is a Continuation of application Ser. No. 10/235,978, filed Sep. 5, 2002 now U.S. Pat. No. 6,729,754, the entire contents of each of which are hereby incorporated by reference.

BACKGROUND OF THE INVENTION

Powered mixers are popular in retail outlets selling paint. When the paint is vended in five gallon buckets (or similar containers), considerable effort required to lift the buckets into and out of the mixers. One form of assistance has been to provide a roller conveyor in front of one version of a paint mixer to raise the bucket to a height at or near that necessary to slide the bucket into the mixer. However, with "drop-in" type paint mixers further lifting effort is still required to move the bucket between the conveyor and mixer. The present invention reduces this effort and provides an attachment that makes it easier to lift five gallon buckets or similar containers of paint into and out of "drop-in" type paint mixers. The present invention will accomplish its function whether or not a conveyor is present in front of the mixer.

BRIEF SUMMARY OF THE INVENTION

The present invention, in one aspect, includes a lifting apparatus for lifting paint containers into and out of paint mixers, where the lifting apparatus is useable in combination with the paint mixer and includes a generally horizontal surface with at least upright member supporting at least one lifting arm including a proximal end pivotably connected to the upright member and a distal end extending beyond the paint mixer, a mechanical link connected to the lifting arm intermediate the proximal and distal ends for lifting and lowering a paint container into and out of the paint mixer, and a spring means connected to the lifting arm for urging the lifting arm vertically upwards.

The present invention, in another aspect, includes a method of assisting movement of a paint container into and out of a paint mixer according to the steps of providing a lifting attachment having at least one lifting arm with a proximal end pivotably connected to a support and a distal end extending beyond the paint mixer, a mechanical link connected to the lifting arm intermediate the proximal and distal ends for lifting and lowering a paint container into and out of the paint mixer, and spring means connected to the lifting arm for urging the lifting arm vertically upwards, engaging the mechanical link to the paint container; and assisting movement of the paint container with respect to the mixer by moving the lifting arm with the assistance of the spring means.

In one aspect the present invention is separate from the paint mixer with its own support structure and may be pivotable or pivotable and slideable with respect to the support structure. The sliding version may utilize a separate support structure or the paint mixer as the support structure.

DETAILED DESCRIPTION

Figure 1:
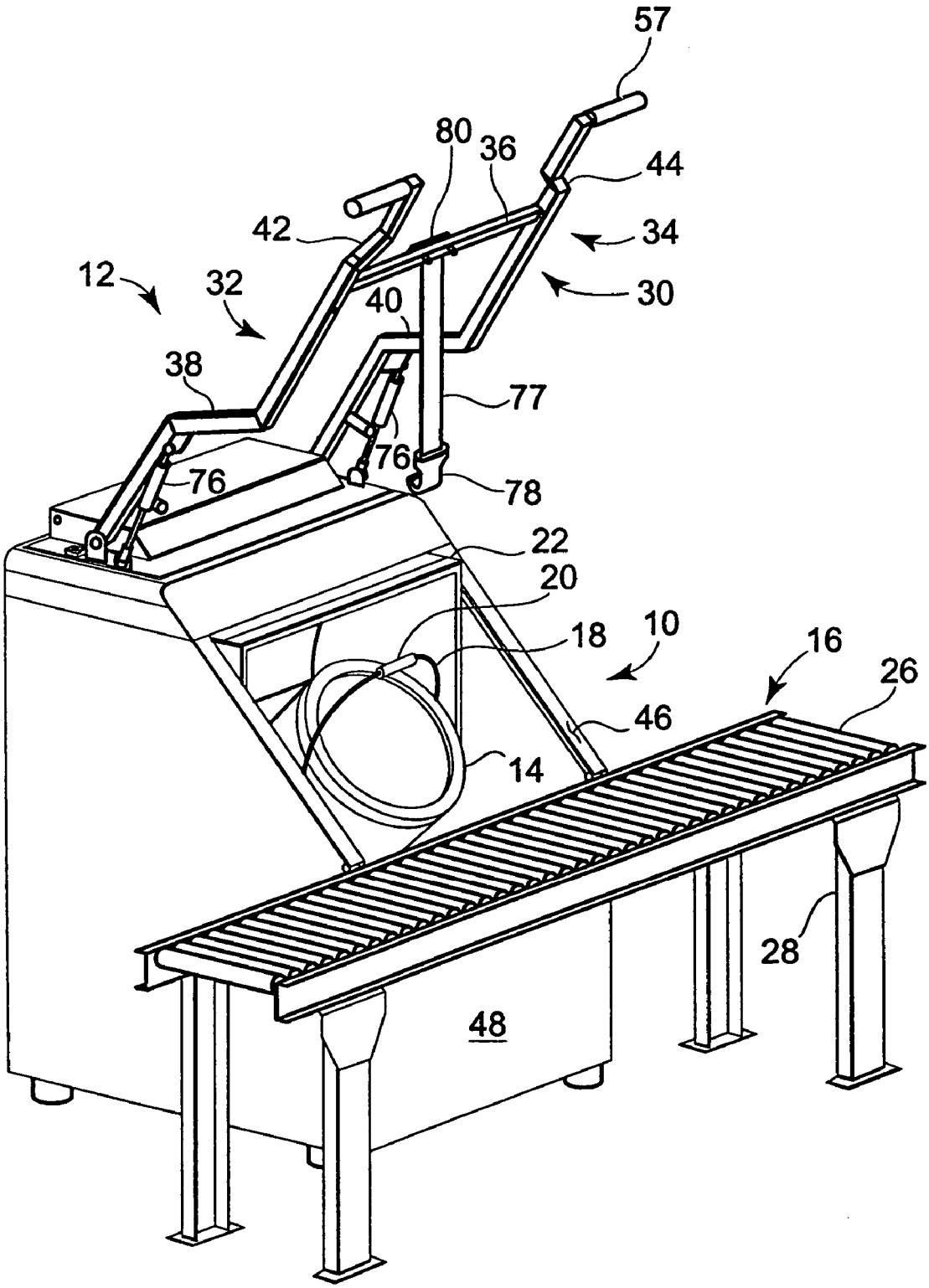
FIG. 1 is a perspective view from the front and above of a conveyor and paint mixer with the lifting attachment of the present invention shown with a paint bucket in the mixer.
Figure 2:
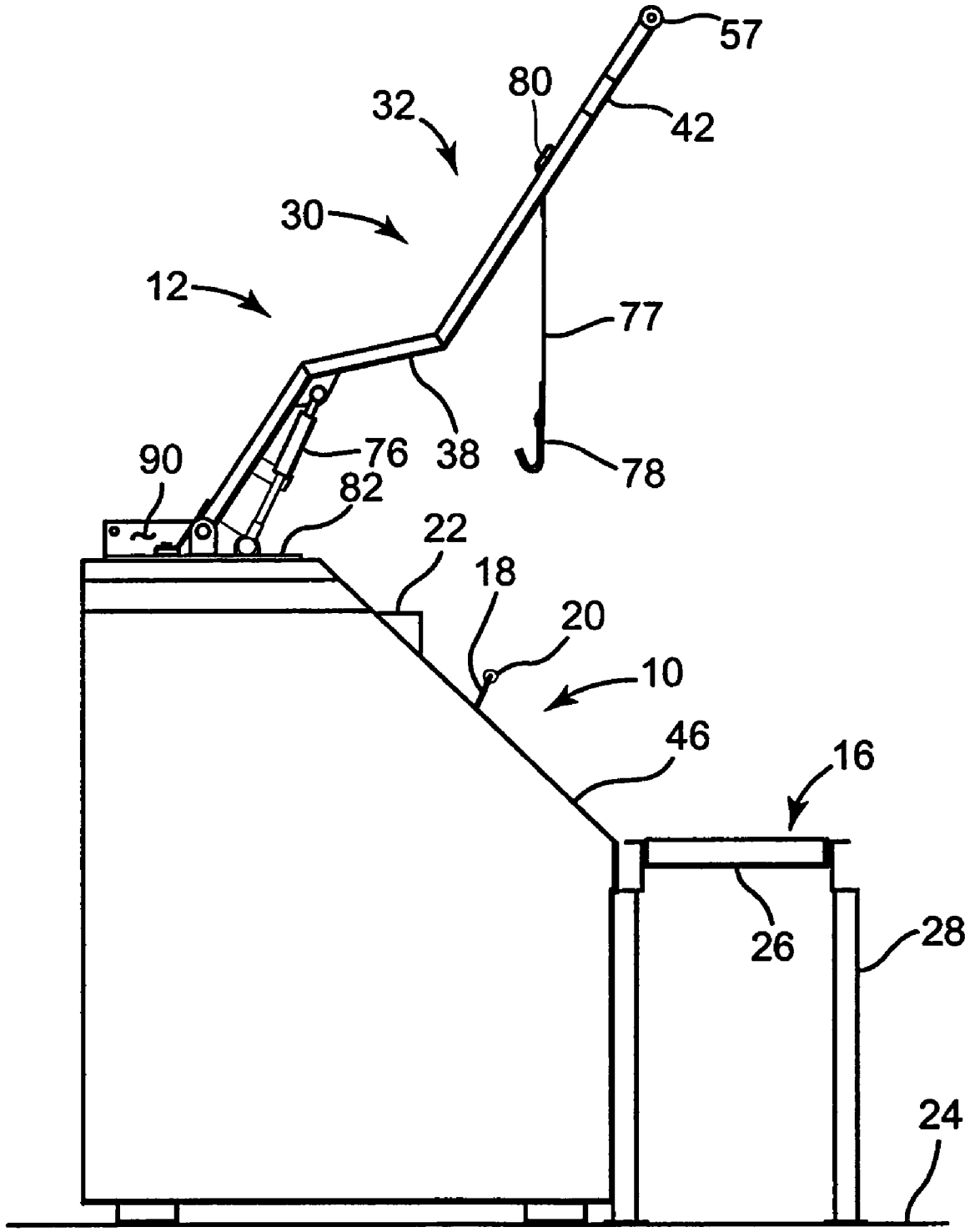
FIG. 2 is a side elevation view of the mixer and attachment of FIG. 1.

Referring now to the Figures, and most particularly to FIG. 1, a paint mixer 10, together with a lifting attachment 12 useful in the practice of the present invention, may be seen. Paint mixer 10 is preferably a Model 5305, available from Red Devil Equipment Co., 7150 Boone Avenue North, Suite 100, Brooklyn Park, Minn. 55428. In the past, it was necessary to manually lift a five gallon paint container or bucket 14 into and out of the mixer. The lifting attachment 12 of the present invention reduces the effort required to move the paint container 14 into and out of the mixer 10. Typically, a conveyor 16 is located in front of the mixer and preferably extends from a colorant dispenser or tinting station (not shown) to the mixer 10 to assist in moving the five gallon buckets 14 of paint from the tinting station to a mixing station at the mixer. It is to be understood that additional conveyor segments are typically present to extend the length of the conveyor 16 as desired. It is also to be understood that bucket 14 has a bail 18 and handle 20. A door or hood 22 is pivotably attached to mixer 10 and is closed prior to operating mixer 10. As may be seen most clearly in FIG. 2, both the mixer 10 and conveyor 16 are preferably supported on a floor or other horizontal surface 24. Conveyor 16 preferably is a non-powered conveyor having a plurality of rollers 26 supported by a frame 28, and may include multiple sections similar or identical to the section shown in the figures to transport paint containers 14 towards and away from mixer 10, as desired.

Referring now also to FIGS. 2*a*, 2*b*, 2*c*, and 2*d*, the lifting attachment 12 preferably includes an arm weldment 30 having a pair of arms 32, 34, and a cross brace 36 welded in an "H" form with two pairs of diagonal offsets 38, 40 and 42, 44. The first pair of diagonal offsets 38, 40 are arranged in arms 32, 34, respectively to conform to a sloping portion 46 of a front side 48 of mixer 10. As used herein, "side" is to be understood to include the front surface of the mixer 10, encompassing one or both of the sloping portion 46 and the vertically oriented parts of side 48. The second pair of diagonal offsets 42, 44 reduce the width between a pair of manually graspable handles 50, 52. Each of arms 32 and 34 are preferably formed of ⅛×1.0×1.0 inch cold rolled hollow steel tubing having a square cross section. The cross brace 36 is preferably formed of 16 gauge 0.50×1.00 inch cold rolled hollow steel tubing. The handles 50, 52 are preferably formed of ⅞ OD cylindrical steel tubing extend from proximal ends of arms 32 and 34, respectively, and each has a conventional vinyl handle grip 57 received thereon. A pair of circular cross section pieces of ⅞ OD steel tubing form a pair of journals 58, 60 at distal ends of the arms 32, 34, respectively, to allow the arm weldment 30 to pivot with respect to its mounting, to be described infra. A pair of cross section pieces of ⅞ OD steel tubing form projections 62, 64 to carry bumpers 65 which limit downward travel of the lifting attachment 12 after installation. A pair of 1 inch wide, 6 gauge steel angle flanges 66 each have an ear 70 formed at an angle of 122 degrees to carry a bumper 69 to limit upward travel of the lifting attachment 12. Bumpers 65 and 69 are conventional, with bumpers 65 preferably having a shore durometer of 40 and bumpers 69 preferably having a shore durometer of 70. A pair of 1 inch wide, 6 gauge steel gussets 72 each have an aperture 74 therein to receive an end of a gas spring 76 to provide lifting support for lifting attachment 12. Gas springs 76 are preferably rated at 80 lbs. and preferably have an operating range of 7.09 to 9.09 inches, with metal ball ends, each having a conventional threaded stud for attachment to the lifting attachment 12 using conventional washers and nuts.

A 2 inch wide strap of nylon webbing 77 carries a hook 78 sized and shaped to receive bail handle 20 on bucket 14. The hook 78 is preferably formed of 7 gauge steel. As may be seen most clearly in FIG. 2*c*, webbing 77 preferably has a pair of loops 79 formed at each end of the strap by stitching the webbing to itself. One loop captures the hook 78, and the other loop is received over a plate clamp 80. The hook and webbing subassembly is preferably sized to enable the hook to release from the handle 20 when the lifting attachment is at or near the lowermost position. The hook and webbing subassembly is preferably secured to the cross brace 36 by the plate clamp 80. As may be seen most clearly in FIGS. 2*c* and 2*d*, conventional nuts are preferably used to secure bumpers 69 and plate clamp 80 to the lifting attachment 12.

Figure 2A:
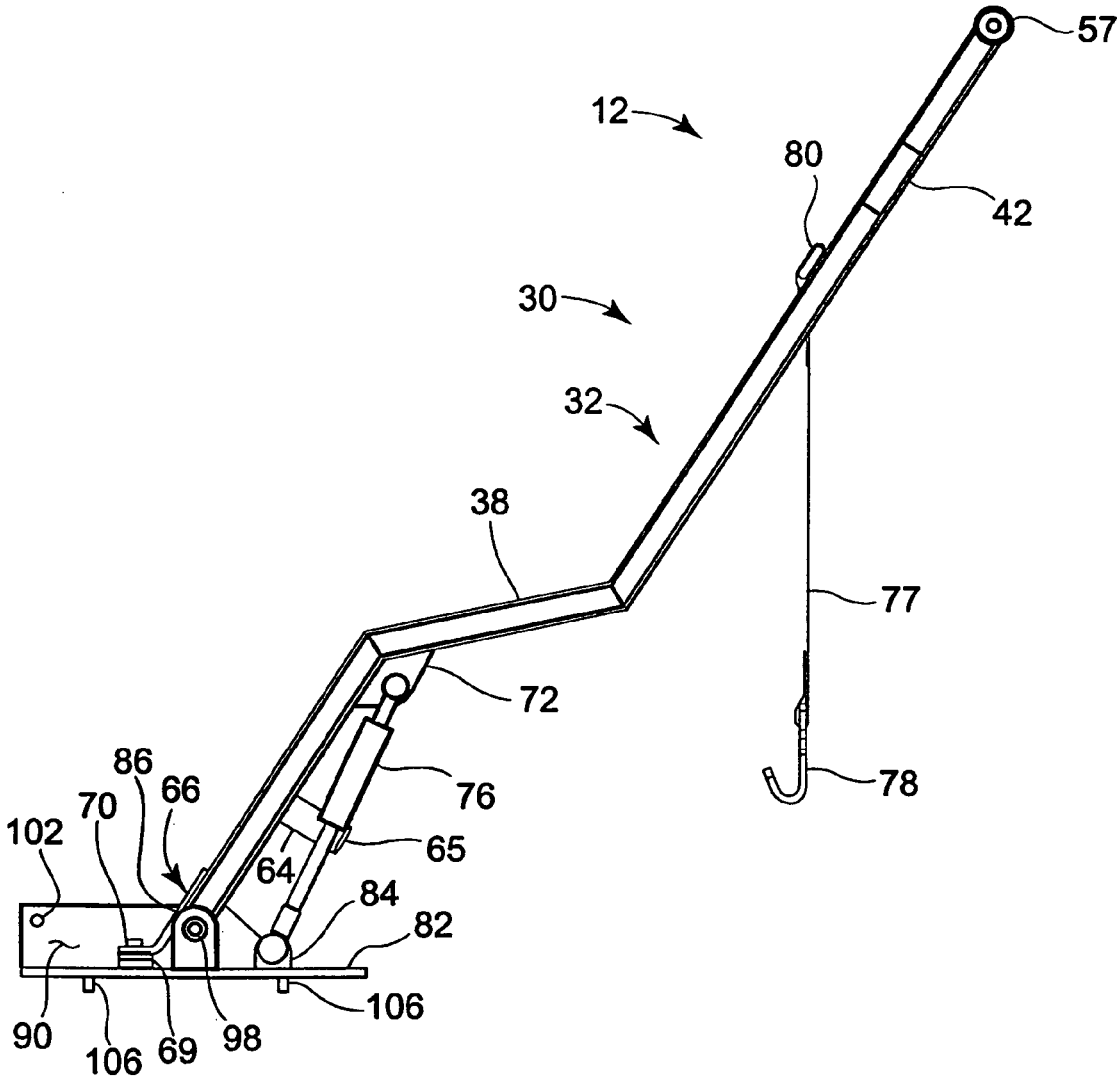
FIG. 2*a* is an enlarged view of a portion of FIG. 2 showing the lifting attachment assembly.
Figure 2B:
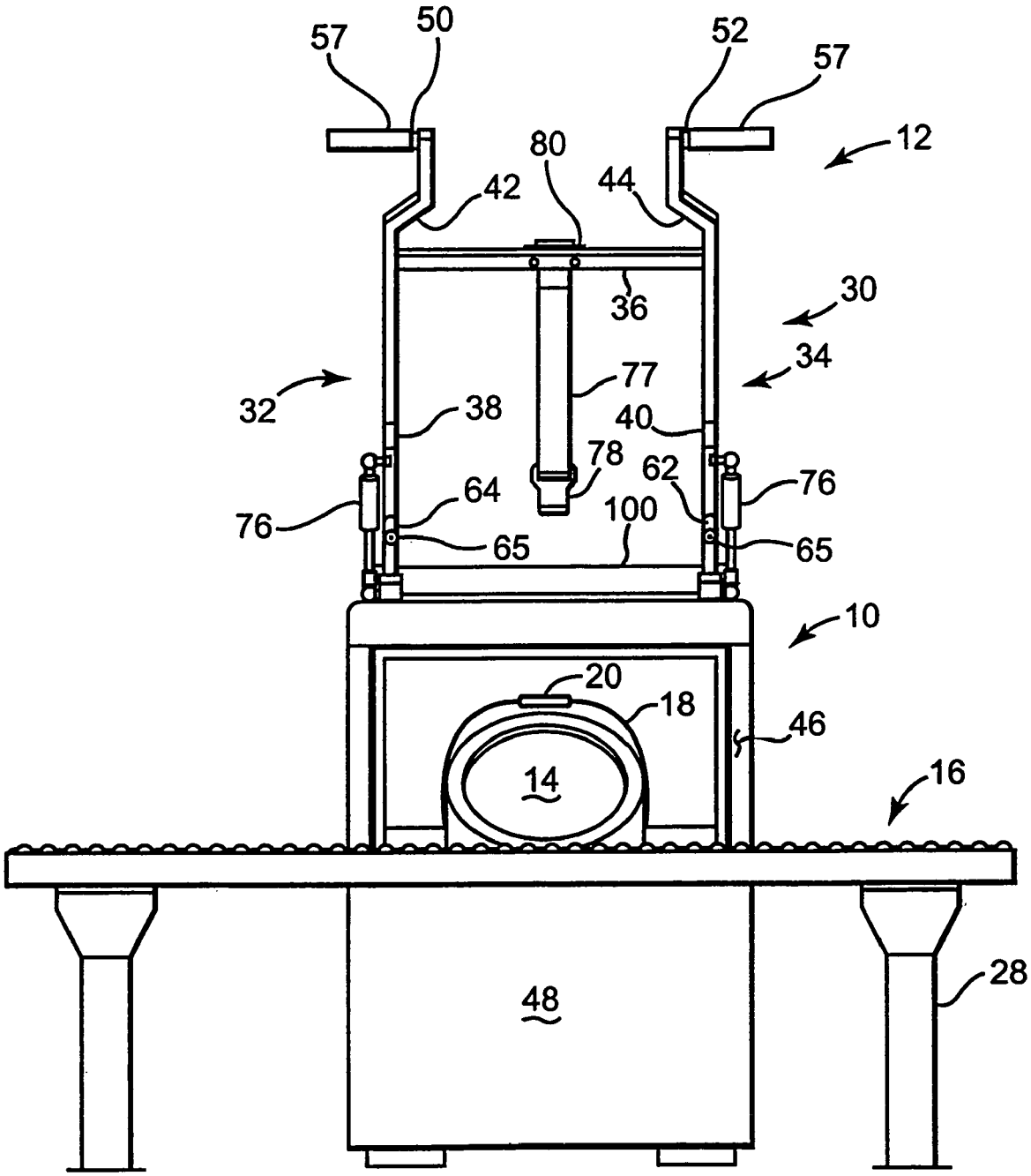
FIG. 2*b* is a front elevation view of the mixer and attachment of FIG. 1.
Figure 2C:
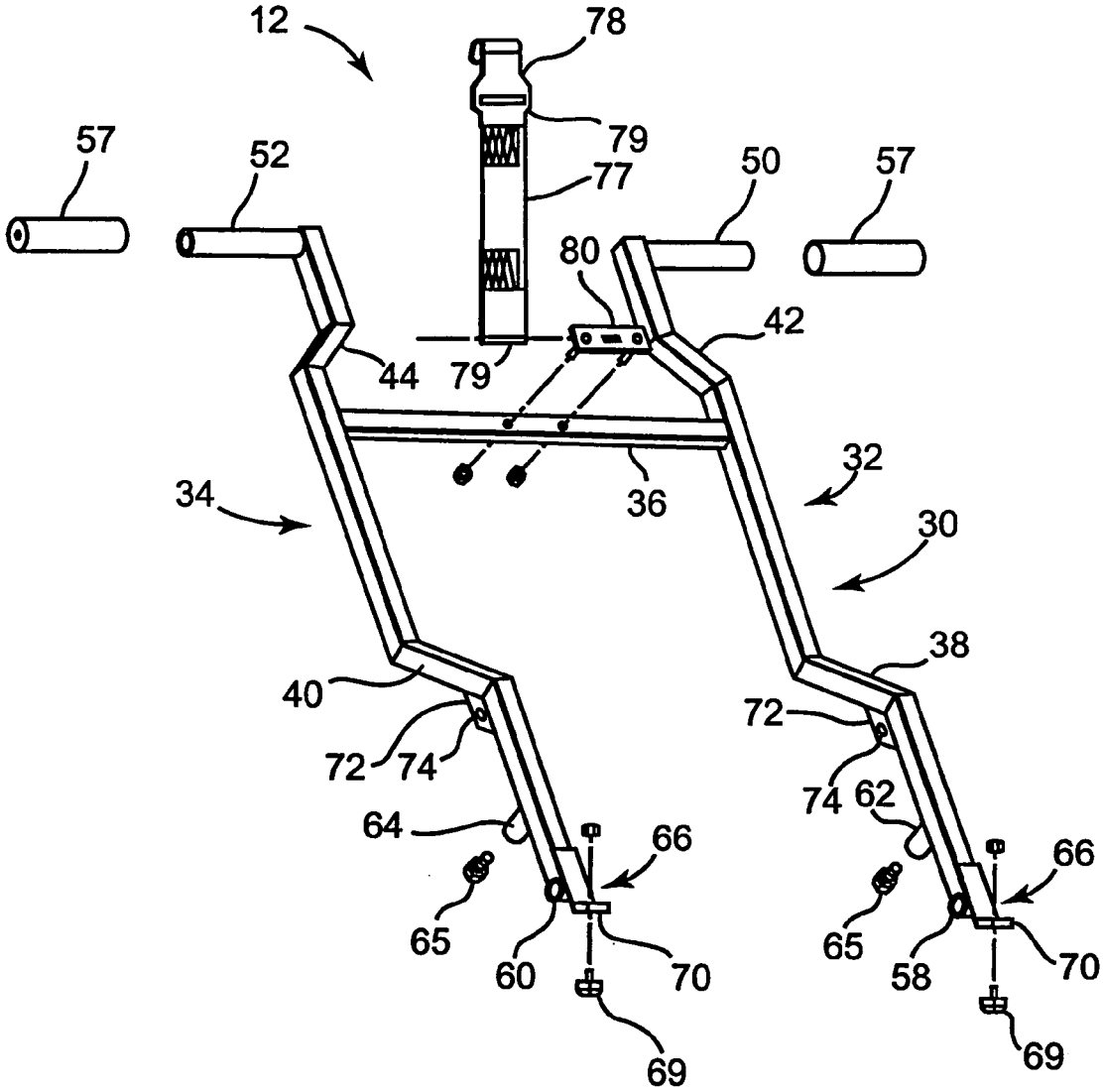
FIG. 2*c* is an exploded view of a weldment subassembly with associated parts useful in the practice of the present invention.
Figure 2D:
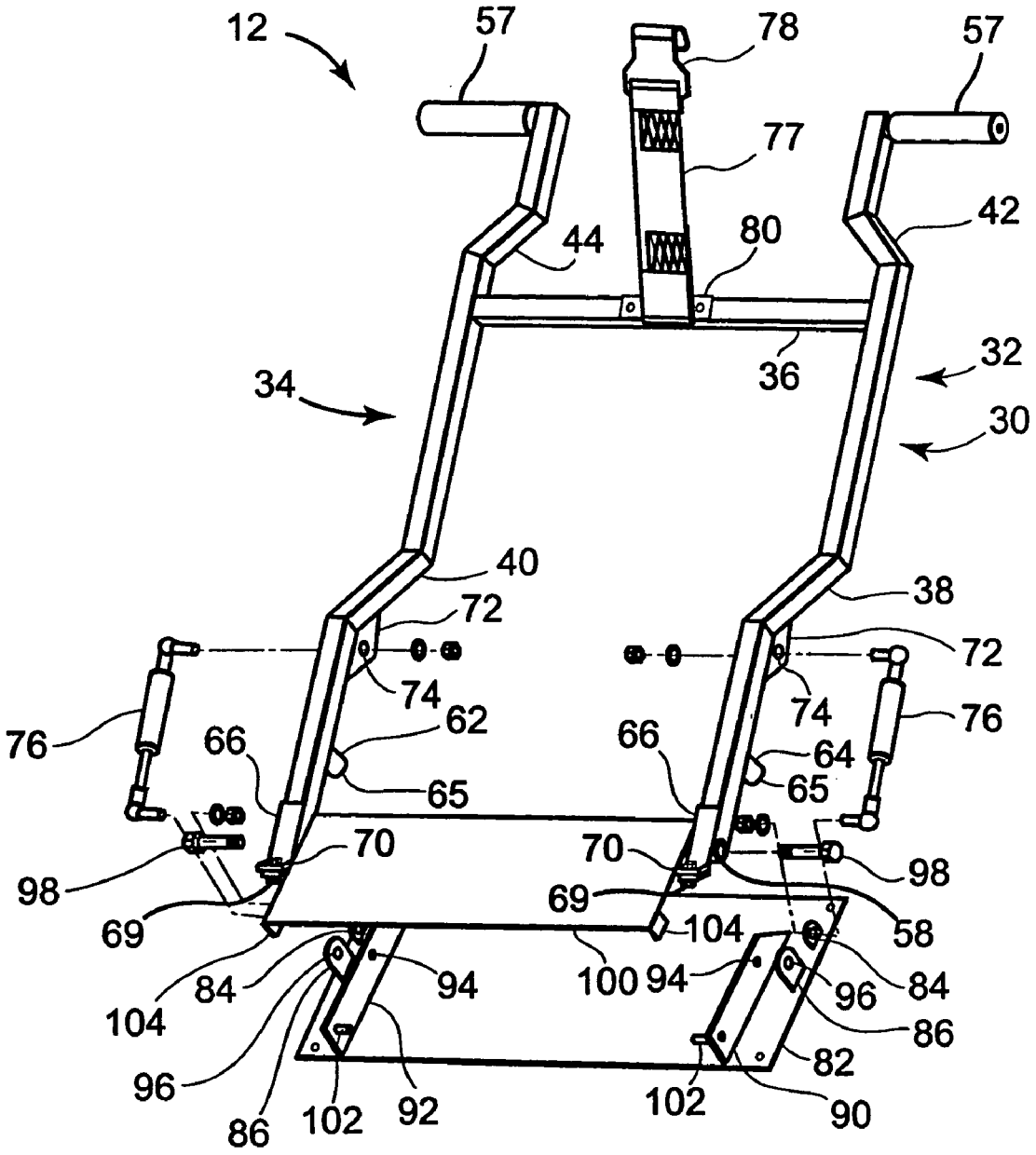
FIG. 2*d* is an exploded view of the lifting attachment assembly.

Referring now most particularly to FIGS. 2*a* and 2*d*, a plate 82 has a first pair of tabs 84 welded thereto for securing the gas springs 76, and further has a second pair of tabs 86 welded to the plate 82 to support the arms 32, 34 at the journals 58, 60. A pair of end walls 90, 92 are similarly welded to plate 82. Each of the tabs 84, 86 and end walls 90, 92 are to be understood to include conventional projections received in notches (not shown) in plate 82 for maintaining the respective locations of these parts as they are welded together. End walls 90, 92 each have an aperture 94 aligned with an aperture 96 in tabs 86 to receive a conventional shoulder bolt 98 to form a pivot in each of journals 58, 60. A decorative sheet metal cover 100 is preferably received over plate 82 and attached to end walls 90, 92 via studs 102 received in slotted tabs 104 welded to cover 100. A conventional nut (not shown) is received over each of studs 102 and tightened to secure cover 100 to the lifting attachment assembly 12.

Referring now again most particularly to FIG. 2*a*, a plurality of studs 106 preferably project downward from plate 82 and are used to secure the lifting attachment assembly 12 to the mixer 10 in a conventional manner.

Figure 3:
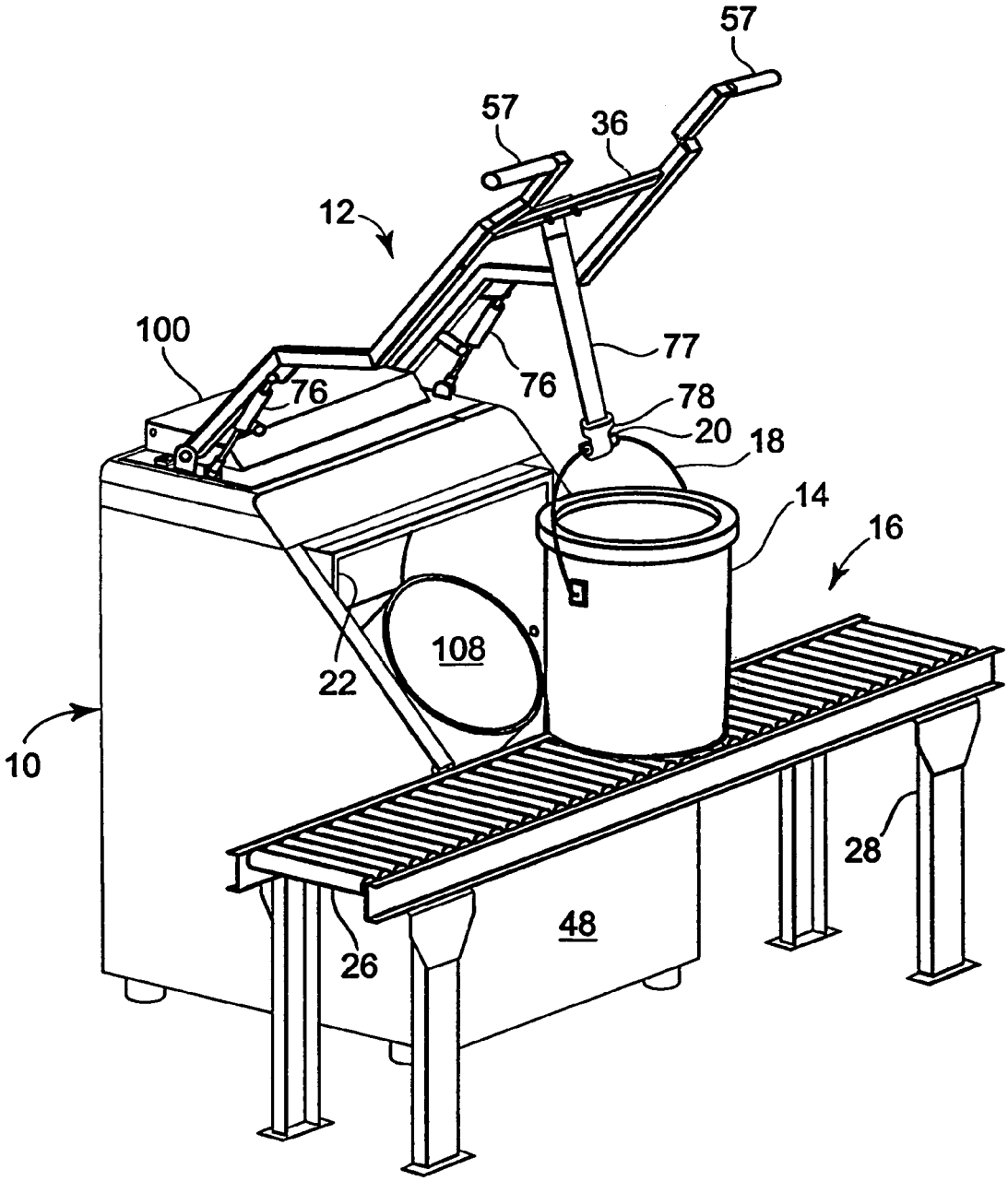
FIG. 3 is a view similar to FIG. 1, except with the paint bucket on the conveyor and the lifting attachment connected to the bucket in a first position.
Figure 4:
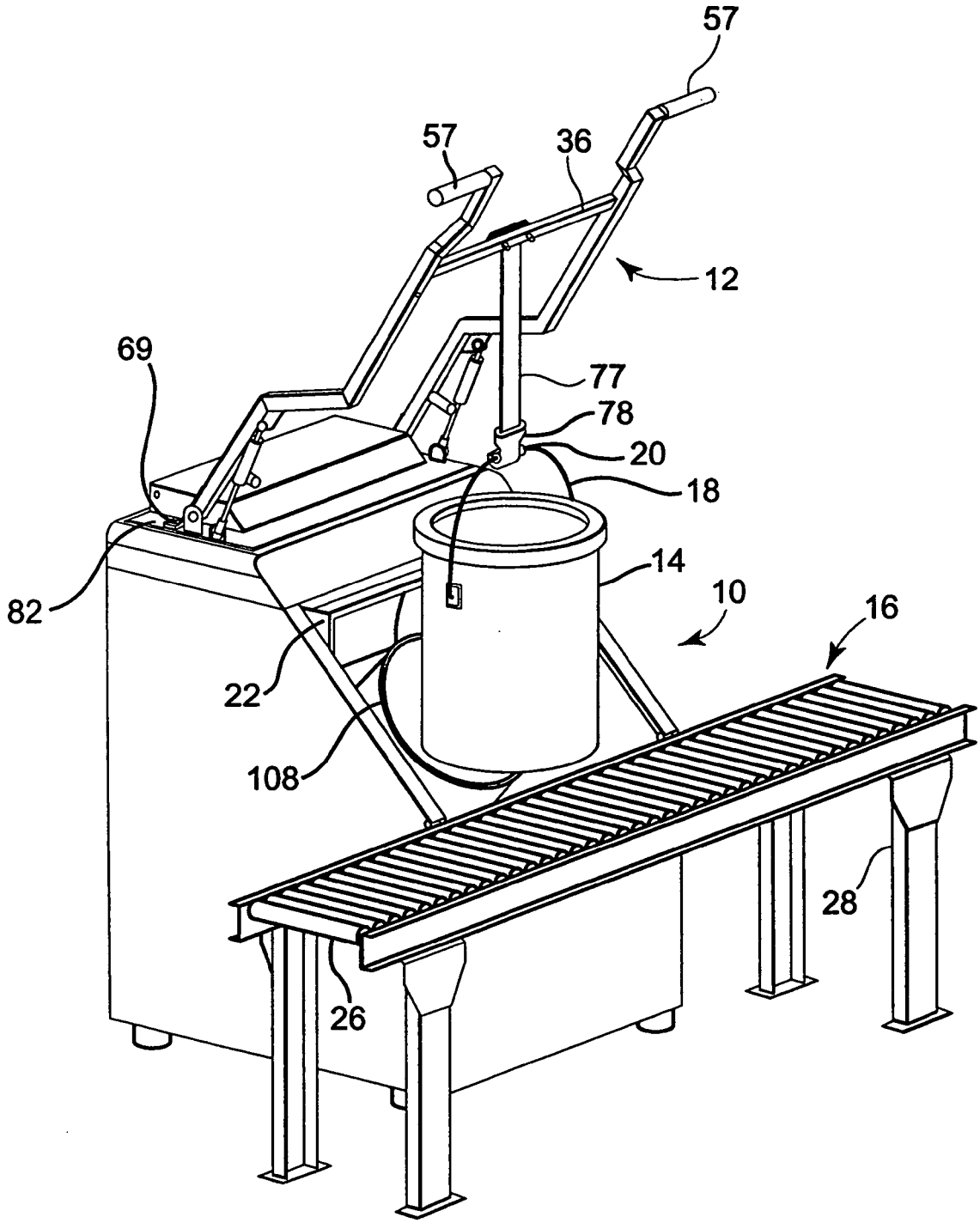
FIG. 4 is a view similar to that of FIG. 3, except with the lifting attachment raised to lift the bucket to a second position.

Referring now to FIGS. 3, 4, 5 and 6, the operation of the lifting attachment will be explained. In FIG. 3, a paint bucket 14 is shown located on the conveyor 16 just prior to insertion into the mixer 10. At this position, the arms 32, 34 of the lifting attachment 12 have been manually lowered and the hook 78 has been manually engaged with the bail handle 20 of the bucket 14. In FIG. 4, the lifting attachment has been manually elevated with the aid of the gas springs 76, by grasping at least one handle grip 57 and raising assembly 12 until the bucket clears a bucket receptacle 108 in the mixer 10. It is to be understood that cross brace 36 will move laterally, as well as vertically, as the assembly 12 is elevated, moving bucket 14 closer to receptacle 108 as the assembly is elevated.

Figure 5:
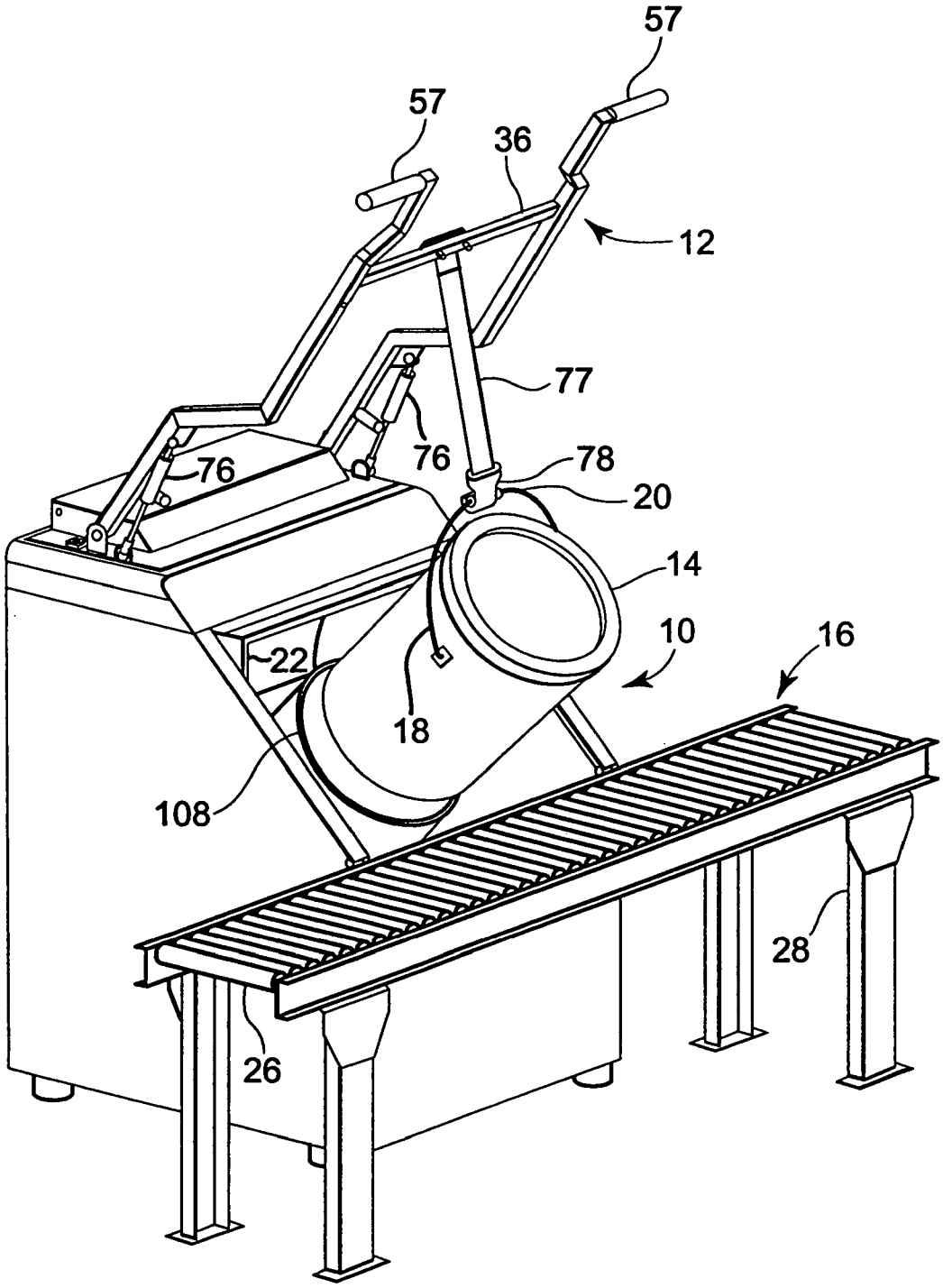
FIG. 5 is a view similar to that of FIG. 4, except with the bucket moved laterally and rotated to a position in which the bucket is about to be received in the mixer while still supported by the lifting attachment.
Figure 6:
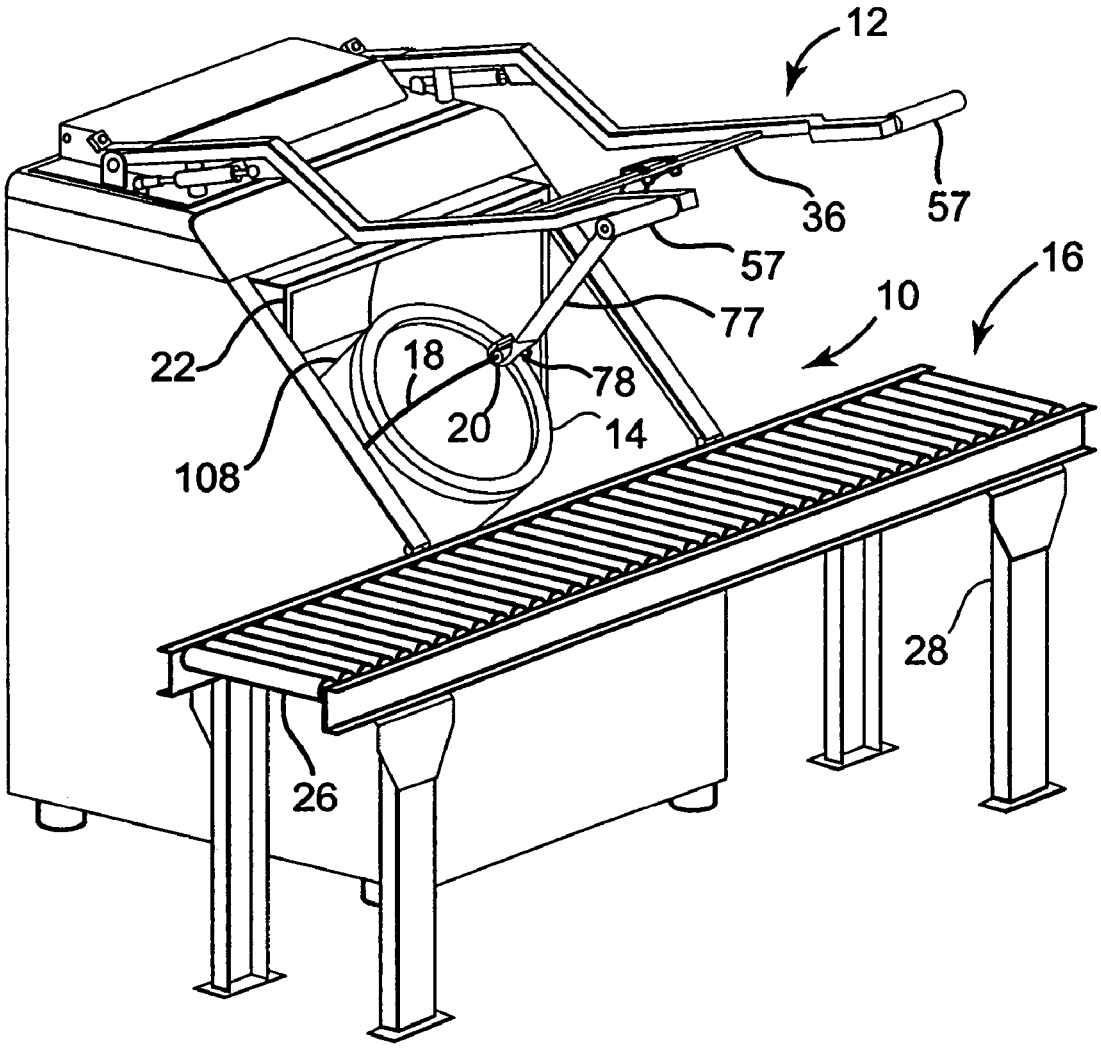
FIG. 6 is a view similar to that of FIG. 5, except with the bucket fully received in the mixer and with the lifting attachment lowered to a position just prior to release from the bucket.

In FIG. 4, the assembly 12 is nearly fully elevated, evidenced by close approach of bumpers 69 to plate 82. At this time, the bucket 14 is positioned over the receptacle 108, but is not aligned therewith. In FIG. 5, the bucket 14 is manually aligned with receptacle 108, while attachment 12 is held in the fully elevated position. The lifting attachment is then lowered to the position shown in FIG. 6, using one or both handle grips 57, while the bucket 14 slides into receptacle 108, coming to rest as shown in FIG. 6. The lifting attachment 12 is shown in FIG. 6 positioned slightly above its lowermost position. This allows arms 32, 34 to be lowered to the lowermost position (not shown) at which time the bail handle 20 is released from hook 78. The lifting attachment is then released from manual control, at which time it will return to the uppermost position similar to that shown in FIGS. 4 and 5, but with the bucket 14 remaining fully received in receptacle 108. It is to be understood that the uppermost position will allow the lifting attachment to move (preferably about four inches in travel) higher than that shown in FIGS. 4 and 5, to enable the lifting attachment to rest in a position providing greater clearance to the mixer 10 than that shown in FIGS. 4 and 5. After the lifting attachment is elevated and released, door 22 is closed on mixer 10 and the paint is agitated by mixer 10, after which the door 22 is opened and the process described above is repeated in reverse order to lift the bucket 14 from the mixer and return it to the conveyor 16.

Figure 7:
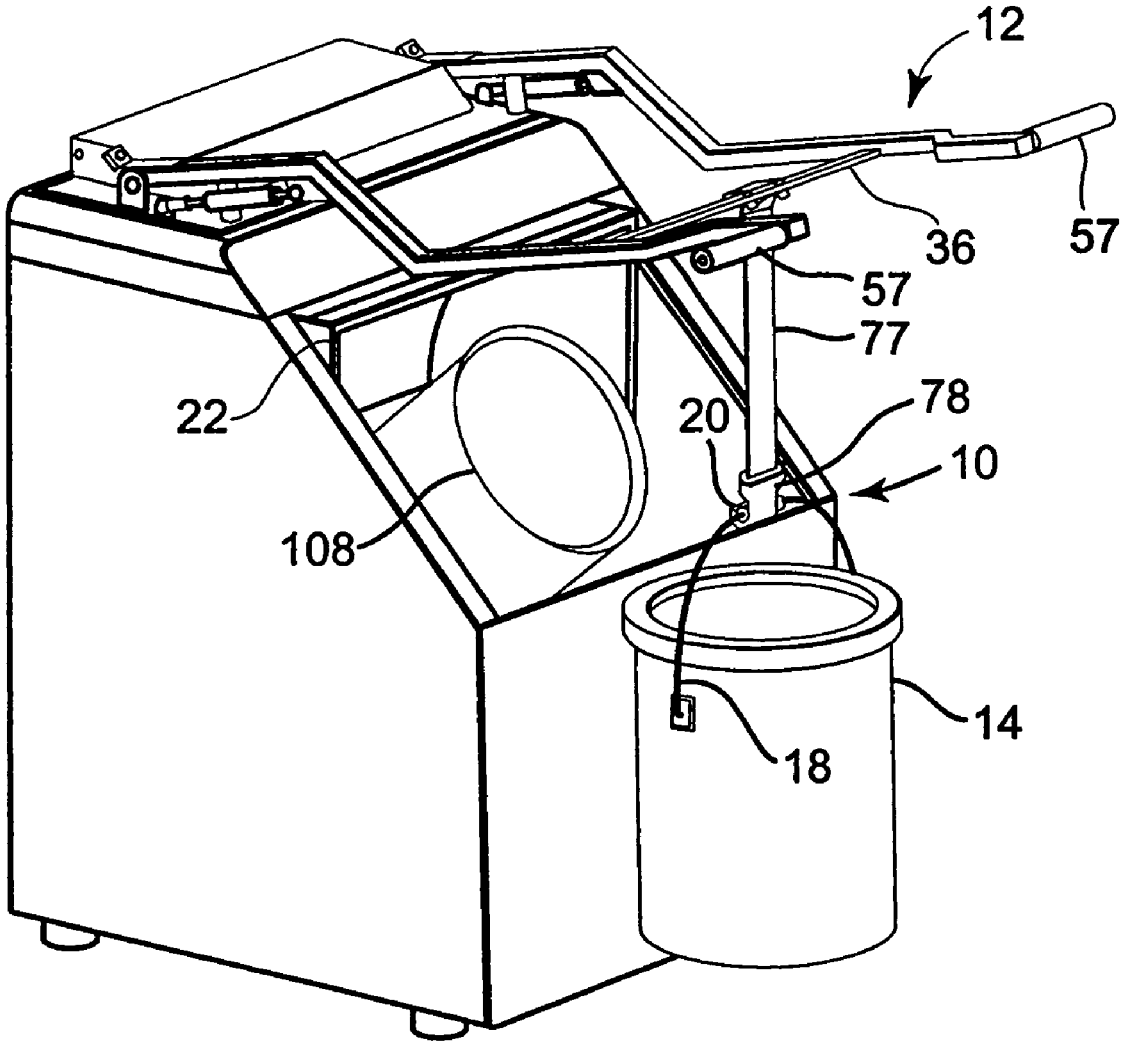
FIG. 7 is a view similar to FIG. 3 except without a conveyor and with the bucket elevated slightly above the surface supporting the paint mixer.

In an alternative arrangement as shown in FIG. 7, a paint bucket 14 may be located on the floor 24 in front of mixer 10, where the lifting attachment 12 may be used to assist raising the bucket 14 from the floor and into and out of the mixer 10. The conveyor 16 is absent from this arrangement.

Figure 8:
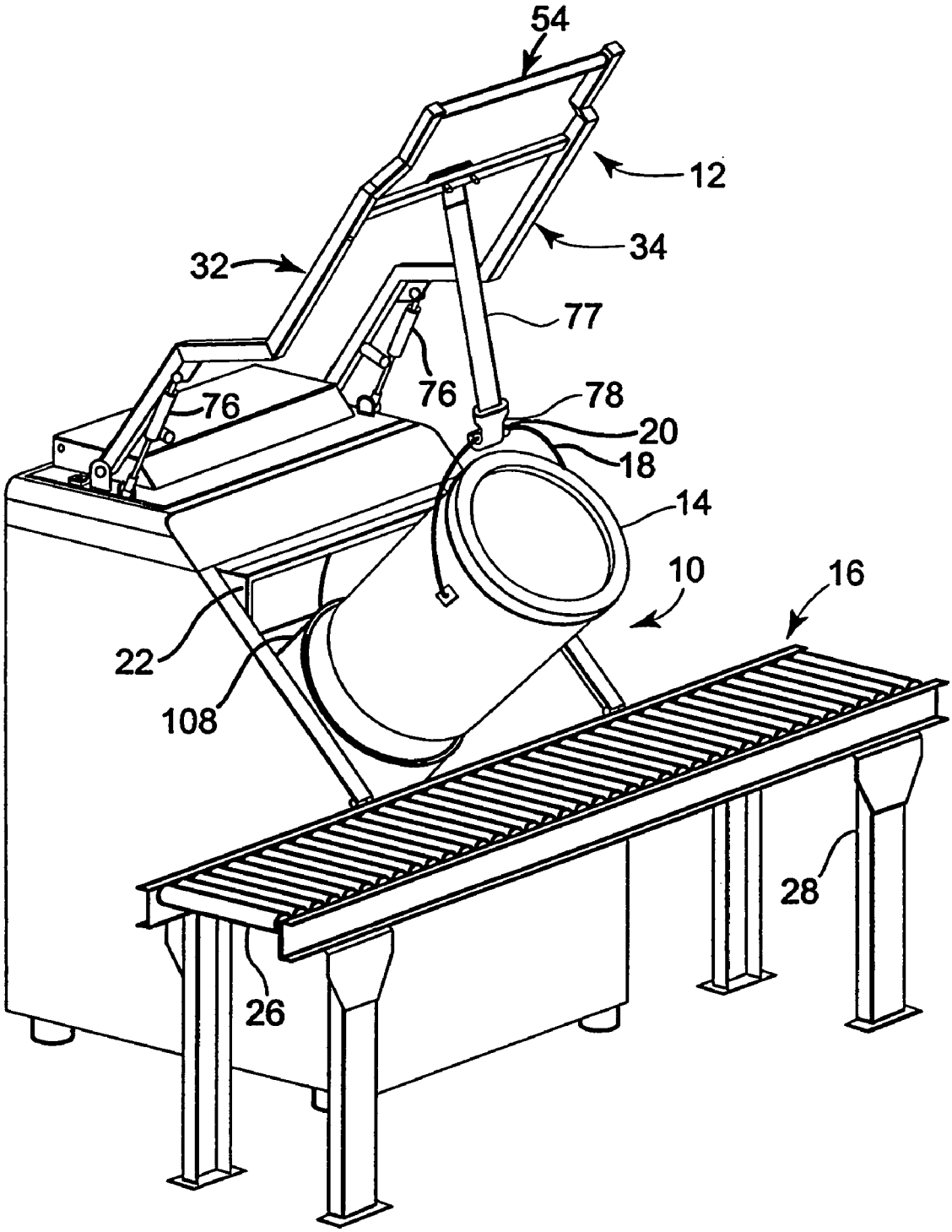
FIG. 8 is a view similar to that of FIG. 5, except with a single handle.

Referring now most particularly to FIG. 8, an alternative embodiment of the present invention may be seen. In this embodiment, a single elongated handle 54 extends between the arms 32 and 34. Handle 54 may have a vinyl grip thereon, similar to grip 57 for handles 50 and 52.

Figure 9:
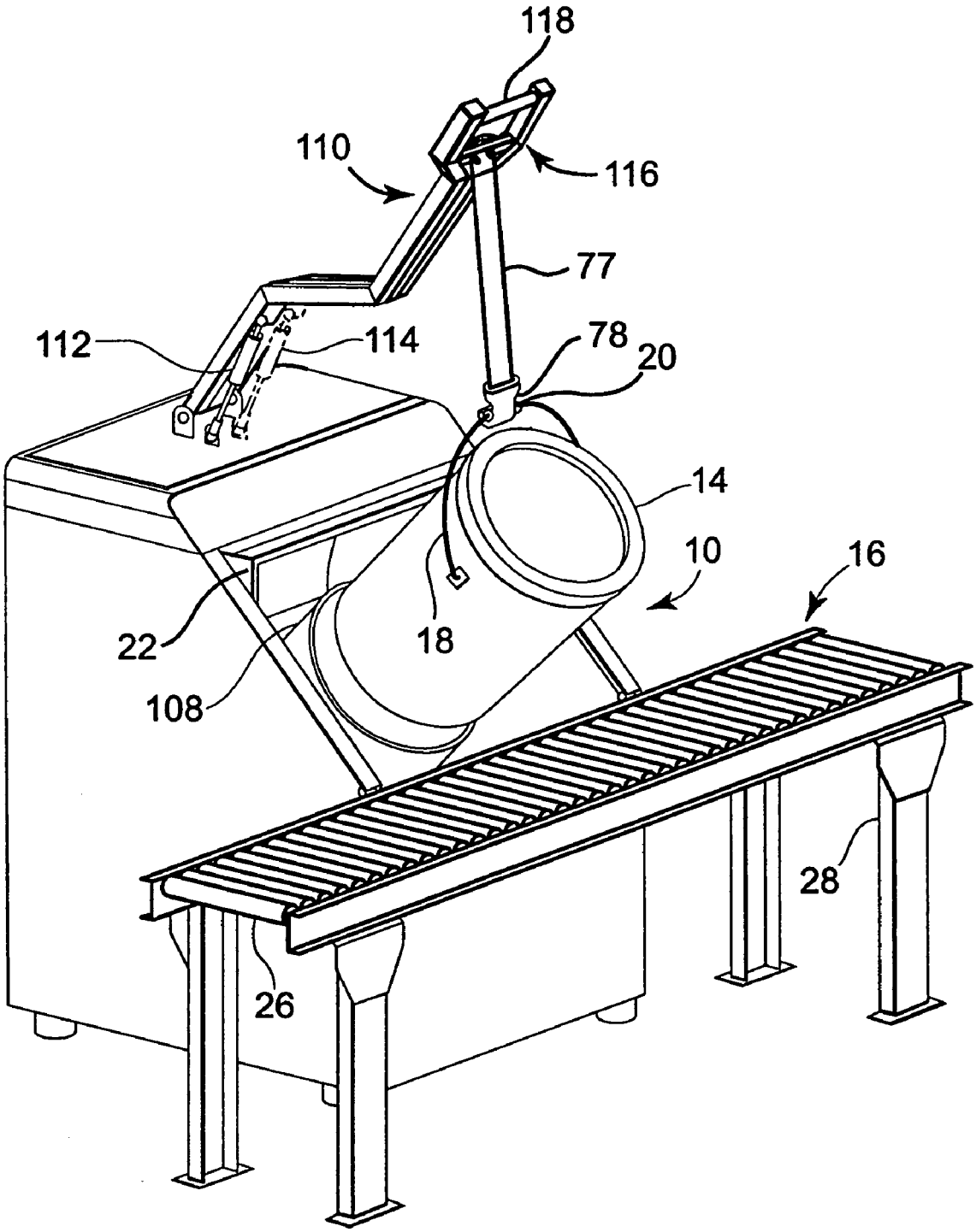
FIG. 9 is an alternative embodiment showing a single arm version of the lifting attachment useful in the practice of the present invention.

Referring now to FIG. 9, a still further alternative embodiment of the present invention utilizes a single arm 110 replacing and performing the functions of arms 32 and 34. Arm 110 may be made of stronger material, if desired, or may be made of larger cross section material, to adequately support the increased loading for a single arm embodiment. An increased capacity spring 112, preferably doubling the force of spring 76, (but with the same stroke) may be used in this embodiment. Alternatively a pair of springs 112, 114 may be used with ratings the same as springs 76. In this embodiment, a yoke or Y-shaped member 116 may be used to support webbing 77, and a single handle 118 is preferable, with a vinyl grip, if desired.

Figure 10:
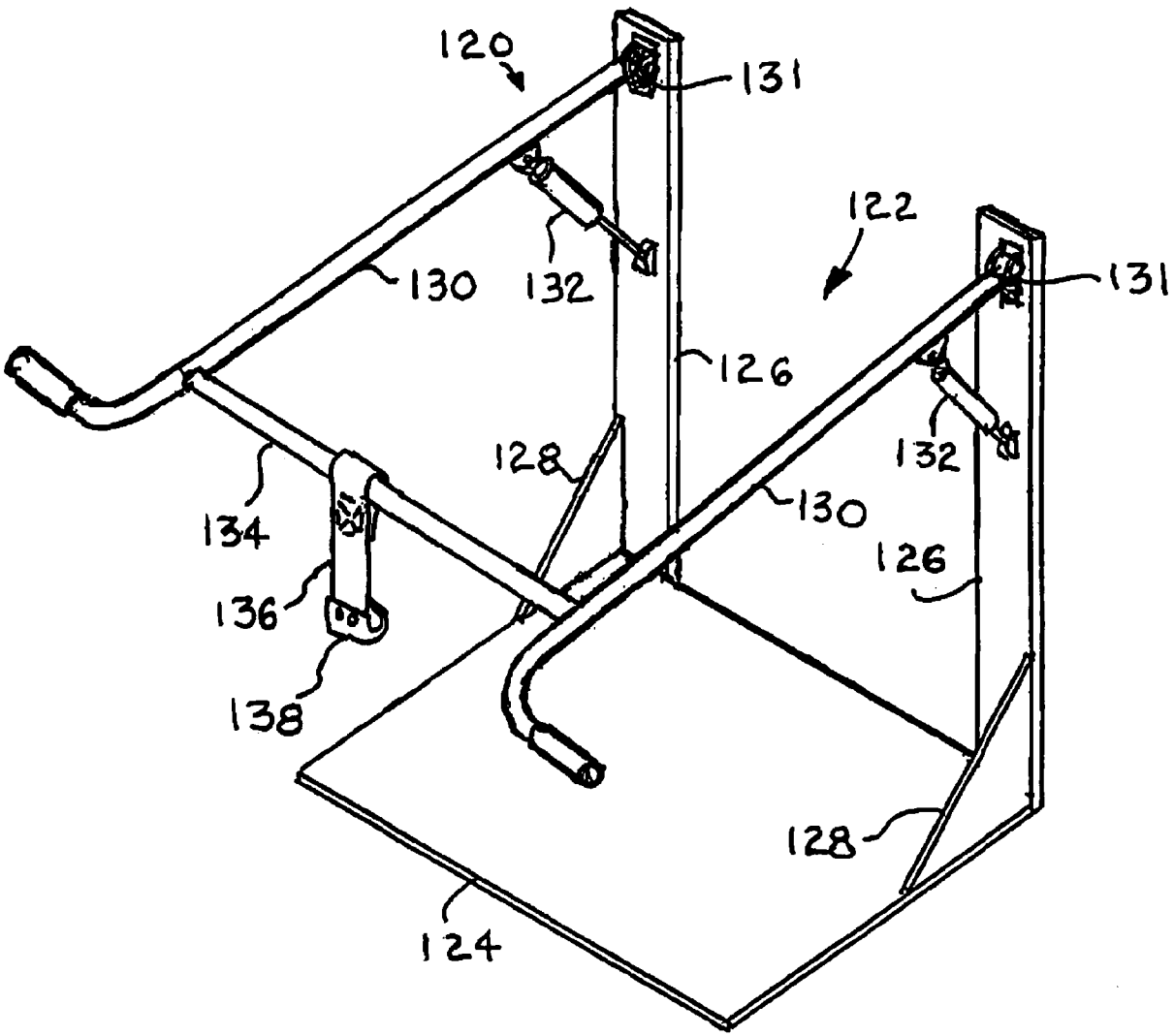
FIG. 10 is another alternative embodiment of the present invention in a free-standing form useful in the practice of the present invention.
Figure 11:
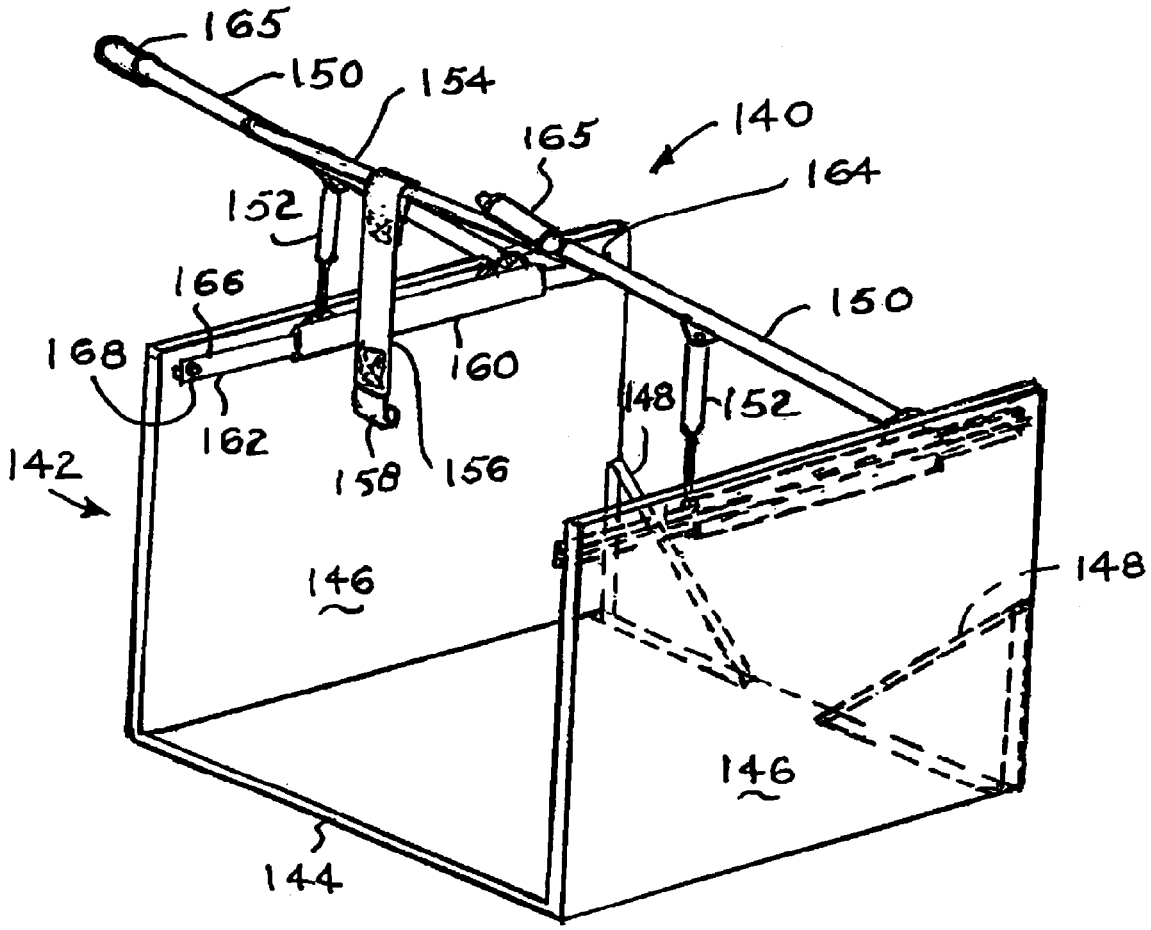
FIG. 11 is still another alternative embodiment of the present invention using a sliding and pivoting motion in the practice of the present invention.

Referring now to FIGS. 10 and 11, it may be seen that the present invention may be practiced with free standing versions of the lifting apparatus. FIG. 10 shows an embodiment for a lifting apparatus 120 which is preferably not permanently attached to a paint mixer, but instead, is designed to have a paint mixer (such as the paint mixer 10) resting on it. A support structure or frame 122 includes a base member 124 and a pair of upright members 126. Each upright member may be reinforced with a gusset 128. Each upright member 126 has a lifting arm 130 pivotably attached thereto at pivot joints 131, and a gas spring 132 or other device adapted to provide a lifting force is connected between the respective arm 130 and upright member 126. A cross member 134 is secured between arms 130, and carries a lifting strap 136 and hook 138. It is to be understood that the lifting apparatus 120 may be the same or similar to lifting attachment 12, except that it is not attached to the paint mixer, either directly or indirectly, but has its own support frame which may take various forms, provided that (in this embodiment) the support frame is free-standing with respect to the paint mixer. The operation of this embodiment is the same as that described for the previous embodiments. Furthermore, it is to be understood that the upright members may be located at the sides or even the front of the mixer, as alternatives to the embodiment shown in FIG. 10, where the upright members are shown in a position where they would be located at the back of the mixer.

Figure 10A:
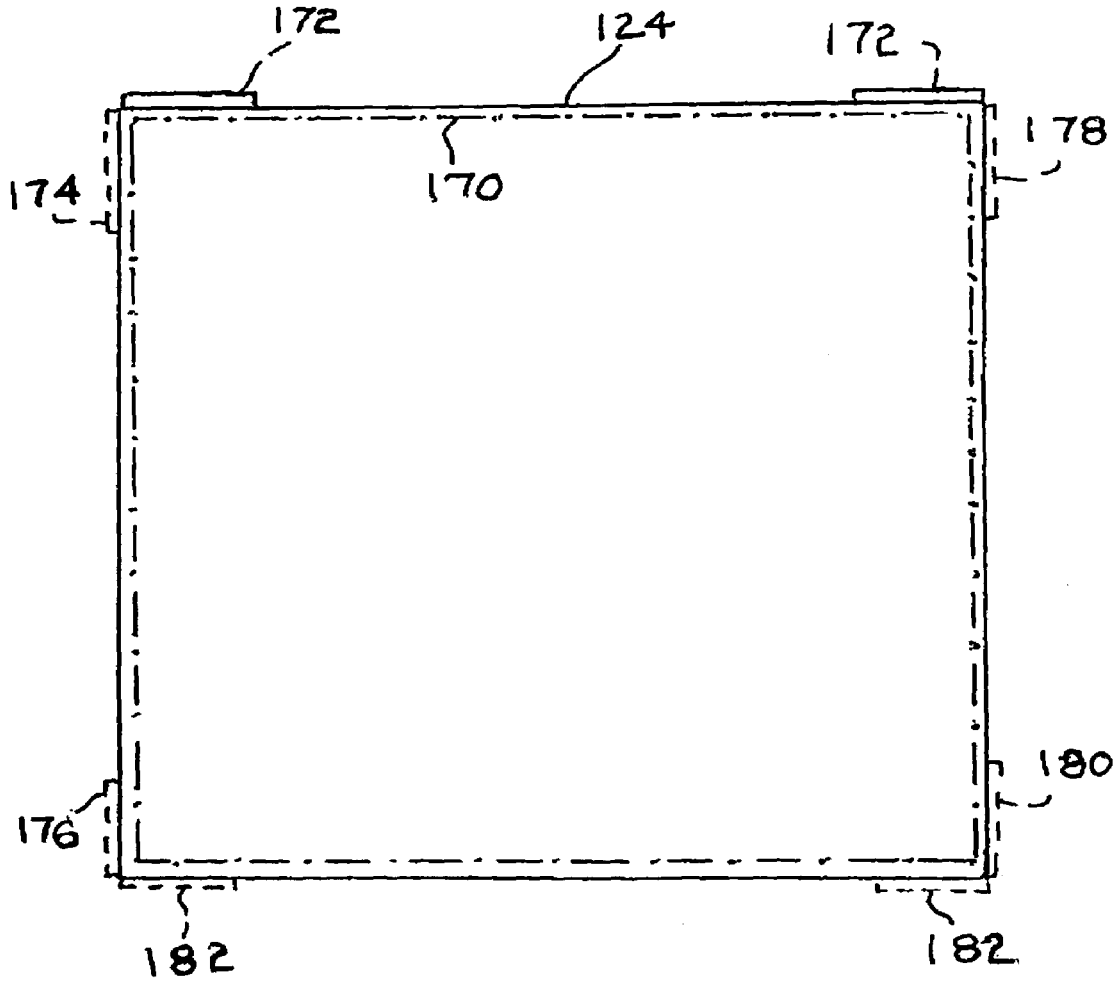
FIG. 10*a* is a simplified plan view of an arrangement for the practice of the present invention.

FIG. 10*a* is a simplified plan view of a "footprint" of the lifting apparatus of the present invention in the embodiments (e.g., shown in FIGS. 10 and 11) which are separate from the mixer. The base member 124 is shown as a frame of reference, with rear positions 172 shown to correspond to the positions of the upright members 126 of the embodiment shown in FIG. 10. Alternative locations for the upright members are at the sides of the paint mixer at locations 174-180, or any where between locations 174 to 176 and 178 to 180. As a still further alternative, the upright members may, if desired be located at the front of the mixer, as indicated at locations 182. It is to be further understood that one or more upright members 126 may be located at the rear of the mixer between locations 172, if desired, for example, to support a lifting attachment similar to that shown in FIG. 8 or 9. Chain line 170 indicates a position for the mixer 10 with respect to the base member 124 of the lifting attachment 120, with it being understood that clearance is provided either at the sides of mixer 10 or above mixer 10 for the gas springs 132 and their attachments to upright members 126, which may be similar to tabs 84 (see FIGS. 2*a* and 2*d*).

Figure 10B:
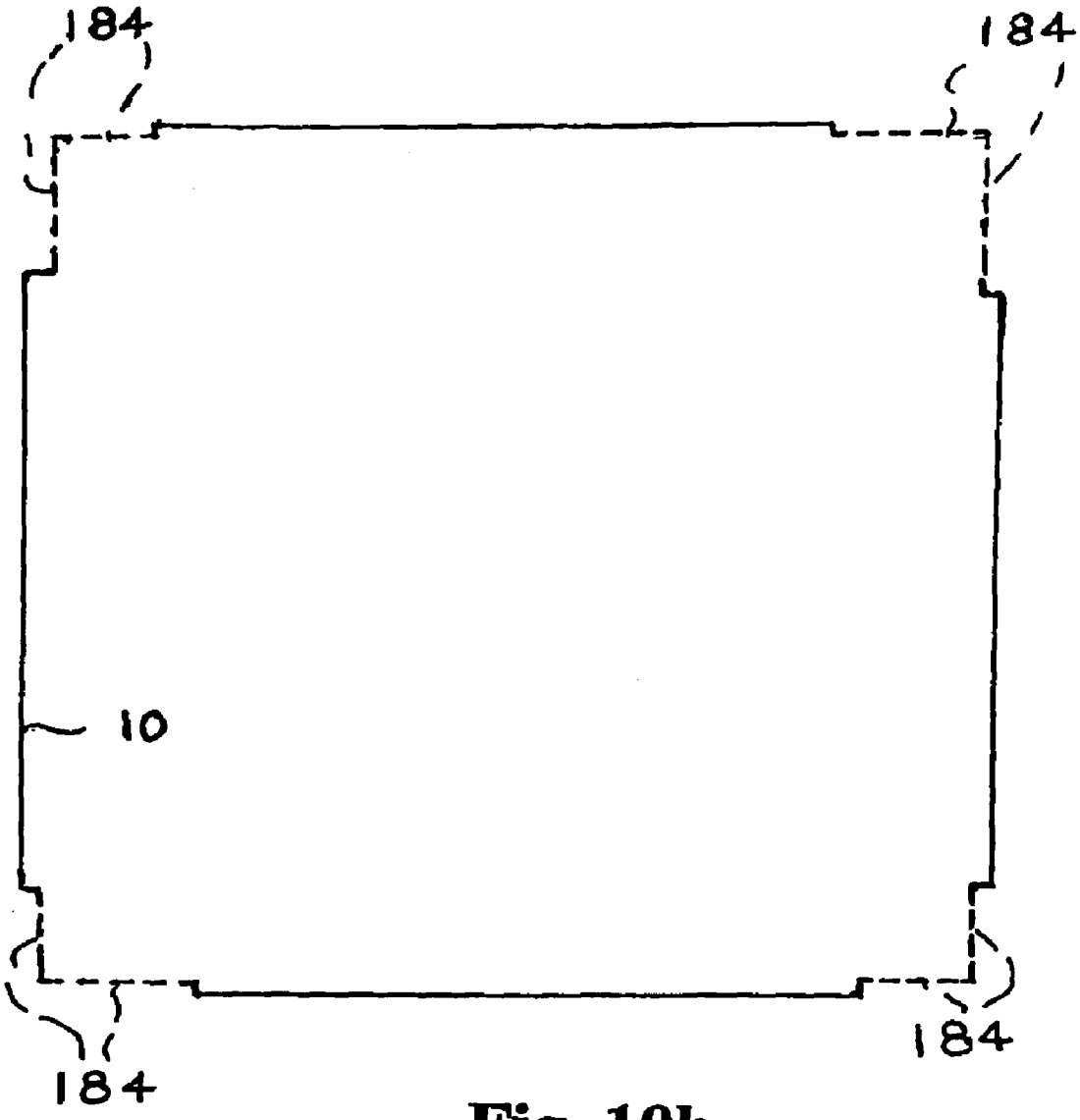
FIG. 10*b* is a simplified plan view of an alternative arrangement for the practice of the present invention.

Referring now to FIG. 10*b*, a simplified plan view of a "footprint" of a modified paint mixer 10' may be seen. In this view, mixer 10' may be "notched" or recessed at any of positions 184 to accommodate upright members 126. The housing of the mixer may be inset as shown, or the housing may be "pushed out" in the regions intermediate "notches" 184 that are used to accommodate the upright members 126. It is to be understood that, although notches 184 are shown adjacent corners, the notches may be located at alternative positions corresponding to such alternative positions described for the upright members with respect to FIG. 10*a*.

Referring now most particularly to FIG. 11, another version of the present invention shows a lifting apparatus 140 which, as shown, has its own support frame 142. In an alternative embodiment (not shown) the sliding and pivoting arrangement of this embodiment may be attached to the paint mixer, if desired. Referring to FIG. 11, support frame 142 has a base member 144 and a pair of upright members 146 with gussets 148. Lifting apparatus 140 has a pair of lifting arms 150 and a pair of gas springs or other lifting force devices 152. A cross member 154 is secured between lifting arms 150 and supports a strap 156 carrying a hook 158, as in earlier embodiments. Lifting apparatus 140 differs from the embodiments described above in that each of the arms 150 and lifting force devices 152 are pivotably attached to respective slide rails 160 which are slideably mounted on respective slide supports 162. As shown the slide supports are mounted on the upright members 146, but in an alternative version, the slide supports may be mounted to respective lateral sides of the paint mixer 10. It is to be understood that the slide rails may be similar to drawer slides. Slide rails 160 are free to move by sliding along a predetermined length of slide supports 162, with end stops 168 limiting travel of the rails or cars 160 at the respective ends of supports 162.

In operation, the lifting apparatus 140 may be stored by moving the slide rails 160 fully to the rear or distal end 164 of the slide supports 162. To lift a paint container, the lifting apparatus 140 is preferably grasped by one or both handles 165 and moved forward by advancing slide rails 160 along slide supports 162 toward proximal end 166. Stops 168 provided at each of ends 164, 166 of support 160 prevent separating the slide rail 160 from the slide support 162 during normal operation. Once the lifting apparatus 140 is advanced to the proximal end 166 of the slide supports 162, the arms 150 are lowered by pulling down on handles 165 and the hook 158 is engaged with a paint container bail (not shown, but similar to either FIG. 3 or FIG. 7). The arms 150 are then raised by pushing or lifting up with handles 165, with the assist of gas springs 152, raising the paint container up vertically. Next the lifting apparatus 140 is pushed back away from the proximal end 166, moving towards the distal end 164, until the paint container is over the paint container receptacle 108 of the paint mixer 10, similar to the relation of container 14 and receptacle 108 shown in FIG. 4. The paint container is then tipped or allowed to tip into alignment with the receptacle, as shown in FIG. 5, after which the arms 150 are lowered analogously to the position shown in FIG. 6, allowing the paint container to be fully received in the receptacle 108. The process is reversed to remove the paint container from the receptacle using this embodiment. It is to be understood that the details of the pivoting connections to the arms and gas springs of FIGS. 10 and 11 may be the same as those shown and described for prior embodiments, as are the details of the strap and hook. It is to be further understood that the embodiments of FIGS. 10 and 11 may be used with or without a conveyor 16 in front of the paint mixer 10 in the practice of the invention using these embodiments. The embodiments of the lifting apparatus of FIG. 8 or 9 may be used with either of the support frames 122 or 142, shown in FIGS. 10 and 11.

Figure 12:
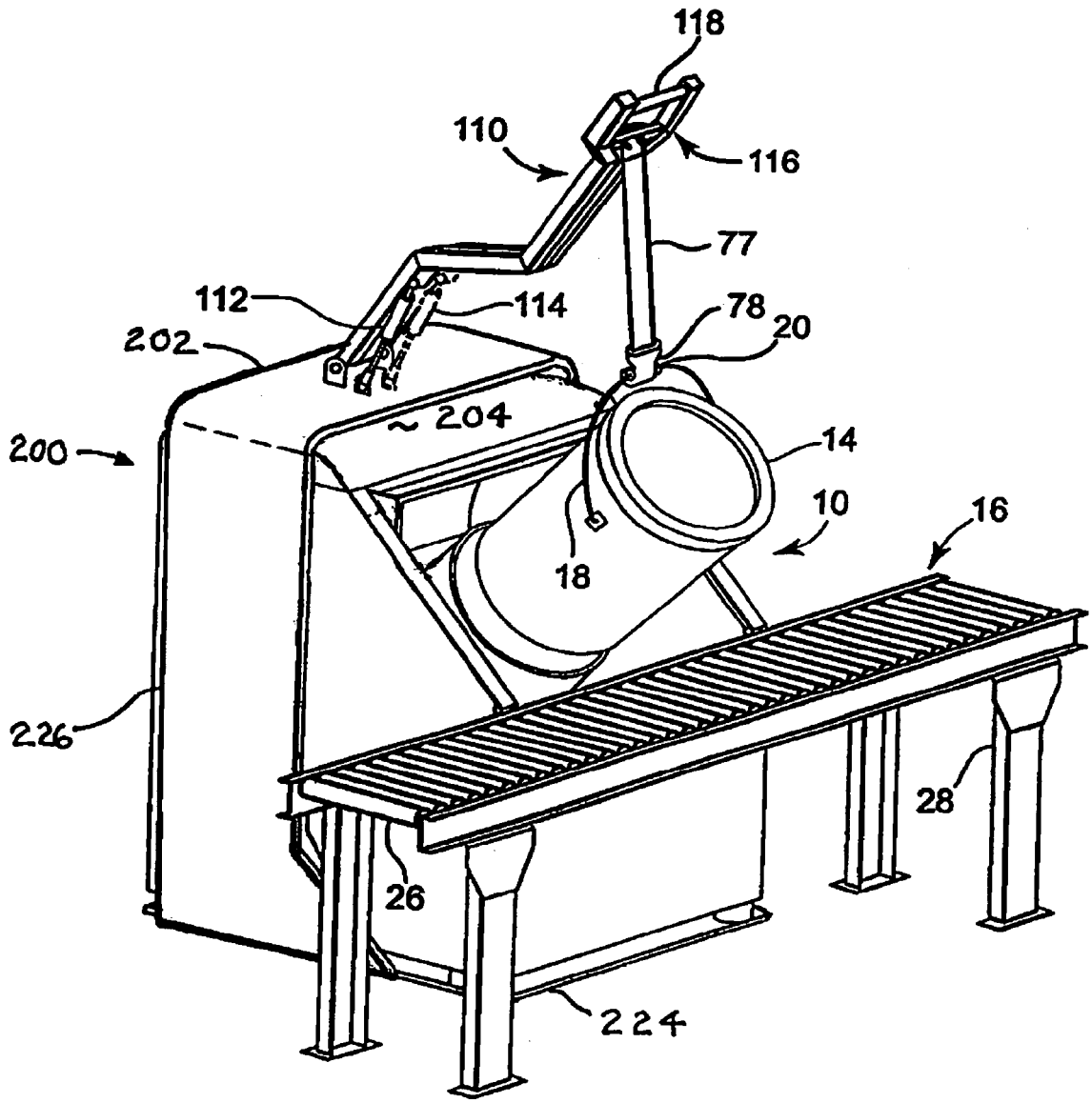
FIG. 12 is another alternative embodiment of a support structure for the lifting apparatus of the present invention.

Referring now to FIG. 12, an alternative support structure 200 for the lifting apparatus of the present invention includes a generally horizontal shelf-like member 202 to which any of the various embodiments of the lifting arms may be attached. Shelf 202 may be integrally formed with a pair of upright members 226. Alternatively, one or more upright members may be separately formed and attached to shelf 202 using conventional fastening means. In the alternative, the upright members) may extend behind the paint mixer 10 and be connected to shelf 202 in a generally C-shaped configuration in which the shelf 202 is cantilevered from the upright member behind the mixer. The shelf 202 may rest on top of or in close clearance to the upper surface 204 of mixer 10. Upright members 226 are preferably attached to a base member 224.

This invention is not to be taken as limited to all of the details thereof as modifications and variations thereof may be made without departing from the spirit or scope of the invention. For example and not by way of limitation, it is to be understood that the present invention is useful in lifting non-cylindrical, as well as cylindrical containers, into and out of mixers. By way of another example, and not by way of limitation, the spring member may be connected to the mixer instead of the support structure (even though the support structure is separate from the mixer) while still remaining within the scope of the present invention.

What is claimed is:

1. A combination of a paint mixer and lifting apparatus for lifting paint containers into and out of paint mixers, the mixer and apparatus comprising:

a. a paint mixer;

b. a stationary support structure separate from and closely adjacent to the paint mixer;

c. at least one lifting arm including i. a proximal end movably connected to the support structure adjacent to the paint mixer, and ii. a distal end extending therefrom;

d. a mechanical link connected to the at least one lifting arm for lifting and lowering a paint container into and out of the paint mixer; and e. a spring member connected to the at least one lifting arm for urging the at least one lifting arm upwards.

2. The mixer and lifting apparatus of claim 1 wherein the spring member is also connected to the support structure.

3. The mixer and lifting apparatus of claim 1 wherein the support structure further comprises:

i. a base member, and ii. at least one upright member; and the at least one lifting arm is connected to the at least one upright member of the support structure.

4. The mixer and lifting apparatus of claim 3 wherein the spring member is also connected to the at least one upright member.

5. The mixer and lifting apparatus of claim 1 wherein the support structure further comprises a shelf and the at least one lifting arm is connected to the shelf of the support structure.

6. The mixer and lifting apparatus of claim 1 wherein the mechanical link is connected to the at least one lifting arm intermediate the proximal and distal ends thereof.

7. The mixer and lifting apparatus of claim 1 wherein the support structure includes a pair of upright members.

8. The mixer and lifting apparatus of claim 1 wherein the at least one lifting arm pivots with respect to the support structure.

9. The mixer and lifting apparatus of claim 8 wherein the at least one pivot arm moves linearly with respect to the support structure.

10. The mixer and lifting apparatus of claim 1 wherein the base member is located at least partially beneath the paint mixer.

11. The mixer and lifting apparatus of claim 1 wherein the lifting apparatus comprises a pair of lifting arms.

12. The mixer and lifting apparatus of claim 11 wherein the spring member includes a pair of springs, with one spring associated with each of the pair of lifting arms.

13. The mixer and lifting apparatus of claim 1 wherein the lifting apparatus comprises an assembly having a pair of arms and a cross member rigidly connecting each of the pair of arms together wherein the mechanical link includes a flexible member connected to the cross member, and a hook connected to the flexible member.

14. The mixer and lifting apparatus of claim 13 wherein the flexible member comprises a strap.

15. The mixer and lifting apparatus of claim 1 wherein the paint container is a five gallon container.

16. A method of assisting movement of a paint container into and out of a paint mixer comprising the steps of:

a. providing a lifting apparatus separate from the paint mixer and having at least one lifting arm with a proximal end movably connected to a support structure and a distal end extending therefrom, and a mechanical link connected to the at least one lifting arm for lifting and lowering a paint container into and out of the paint mixer; and at least one spring member connected to the at least one lifting arm for urging the at least one lifting arm upwards;

b. engaging the mechanical link to the paint container; and c. assisting movement of the paint container with respect to the mixer by moving the at least one lifting arm with the assistance of the spring member.

17. The method of claim 16 wherein the mechanical link comprises a strap and hook.

18. The method of claim 16 wherein the lifting attachment further comprises at least one manually graspable handle connected to the at least one lifting arm.

19. The method of claim 16 wherein step c further comprises partially supporting the paint container with the lifting apparatus during movement of the paint container with respect to the mixer.

20. The method of claim 16 wherein step b. comprises lowering the at least one lifting arm.

21. The method of claim 16 wherein step b. comprises linearly moving the at least one lifting arm.

22. The method of claim 16 wherein step b. further comprises sliding the at least one lifting arm generally horizontally.

23. The method of claim 16 wherein step b. comprises both pivoting and linearly moving the at least one lifting arm.

24. The method of claim 16 wherein step c. comprises both pivoting and linearly moving the at least one lifting arm.

* * * * *